United States Patent [19]

Howell

[11] Patent Number: 5,013,026

[45] Date of Patent: May 7, 1991

[54] SHEET STACKING AND INVERTING APPARATUS

[75] Inventor: Michael L. Howell, Parkend, United Kingdom

[73] Assignee: Xerox Corporation, Stamford, Conn.

[21] Appl. No.: 368,617

[22] Filed: Jun. 20, 1989

[30] Foreign Application Priority Data

Jun. 22, 1988 [GB] United Kingdom ..... 8814888

[51] Int. Cl.[5] ..... B65H 29/00

[52] U.S. Cl. ..... 271/187; 271/315; 271/163

[58] Field of Search ..... 271/187, 186, 315, 213, 271/214, 163, 3.1; 270/53; 355/324, 323, 322, 318

[56] References Cited

U.S. PATENT DOCUMENTS

| | | | |
|---|---|---|---|
| 3,162,439 | 12/1964 | Poland et al. | 271/187 |
| 3,968,960 | 7/1976 | Fedor et al. | 271/187 |
| 4,228,997 | 10/1980 | Schoonmaker et al. | 271/315 |
| 4,385,756 | 5/1983 | Beery | 271/186 |
| 4,575,296 | 3/1986 | Kockler et al. | 270/53 X |
| 4,712,785 | 12/1987 | Stemmle | 271/315 X |
| 4,718,655 | 1/1988 | Okayama et al. | 271/187 X |

FOREIGN PATENT DOCUMENTS

| | | | |
|---|---|---|---|
| 62-46859 | 2/1987 | Japan | 271/315 |
| 1521317 | 8/1978 | United Kingdom . | |
| 2006168A | 5/1979 | United Kingdom . | |
| 2168686 | 6/1986 | United Kingdom | 271/187 |

*Primary Examiner*—Kevin P. Shaver
*Assistant Examiner*—David H. Bollinger

[57] ABSTRACT

A disc-stacker for inverting sheets either singly or in sets as they exit a copier enabling dual function N−1 and 1−N sequence copying with either face-up or face-down copies. The stacker comprises a sheet inverter wheel having a slot into which one or more copy sheets to be inverted may be inserted. The sheets are fed into the slots by a pair of feed rolls. A compiler tray is disposed between the feed rolls and the inverter wheel. In the single sheet inversion mode the wheel is rotated each time a sheet is deposited in the slot. The sheet is stripped from the slot by stripping member and falls into a catch tray. The inverter wheel then returns to receive and convey subsequent sheets. In the set inversion mode, the wheel is not rotated until all the sheets of the set have been received in the slot. The compiler tray supports and registers the trail edges of the set of copy sheets before they are inverted. The slot may be restricted to accommodate small sets of up to about 10 sheets and second wider slot may also be provided for larger sets of up to about 100 sheets.

8 Claims, 2 Drawing Sheets

SHEET STACKING AND INVERTING APPARATUS

BACKGROUND OF THE INVENTION

This invention relates to apparatus for inverting and stacking sheet particularly, but not exclusively sheets issuing from a reproducing machine such as a copier or printer.

Copies may issue from a copying machine with their printed sides either face up or face down. When an N-page document is copied the pages have to be copied in the correct order if the copy is to be correctly collated. More particularly, in the case of face up copies, the documents must be copied in reverse, i.e. N−1, order whereas for face down copies the documents must be copied in forward, i.e. 1−N, order.

Because of their inherent design, it is very common for copiers to issue copies face up. Also, it is desirable to be able to feed documents in the natural, forward, i.e. 1−N, sequence. To cater for this combination, it is known to use an inverter which inverts each copy sheet in turn as it issued from the copier. The resultant copy will then have its pages arranged in the correct sequence with the first page facing down.

PRIOR ART

U.S. Pat. No. 4,385,756 Beery describes a sheet inverting and stacking apparatus comprising a sheet inverter wheel having at least one arcuate slot into which a sheet to be inverted may be inserted, means to rotate the inverter wheel from a sheet loading position to a sheet unloading position, means for feeding sheets one at a time into the arcuate slot when the inverter wheel is in the loading position, a sheet stripper at the unloading position for stripping sheets from within the slot, and a catch tray adjacent the unloading position for holding the inverted sheets stripped from the slot in the inverter wheel.

This apparatus will produce correctly ordered copies in the case of either (a) 1−N copying with face up copies, or (b) N−1 copying for face down copies. However, the copies would be arranged in the wrong order for either N−1 copying with face up copies, or 1−N copying with face down copies.

SUMMARY OF THE INVENTION

According to the present invention a similar apparatus with additional capabilities is provided. More specifically, the sheet inverting and stacking apparatus comprises a sheet inverter wheel having at least one arcuate slot into which a sheet to be inverted may be inserted, means to rotate the inverter wheel from a sheet loading position to a sheet unloading position, means for feeding sheets one at a time into the arcuate slot when the inverter wheel is in the loading position, a sheet stripper at the unloading position for stripping sheets from within the slot, and a catch tray adjacent the unloading position for holding the inverted sheets stripped from the slot in the inverter wheel. The slot is adapted to accommodate a plurality of sheets, and adjacent the loading position there is provided a compiler tray for supporting the trailing portions of the sheets fed into the slot by the sheet feeding means.

With the apparatus of the present invention, the copy sheets may be inverted one by one as they issue from the copier, or they may be collated as a set in the inverter and then inverted together as a set. This has the advantage over the prior art that copies can be stacked in the correct order for any combination of 1−N or N−1 copying with face up or face down copies.

In a preferred embodiment the inverter wheel is provided with two slots, the first is adapted to accommodate single sheets or sets of several sheets, for example 10 sheets at most, whereas the second slot is adapted to accommodate much larger sets of, for example, up to 100 sheets.

BRIEF DESCRIPTION OF THE DRAWINGS

An embodiment of the invention will now be described, by way of example, with reference to the accompanying drawings in which.

DETAILED DESCRIPTION OF THE INVENTION

Figure 1:
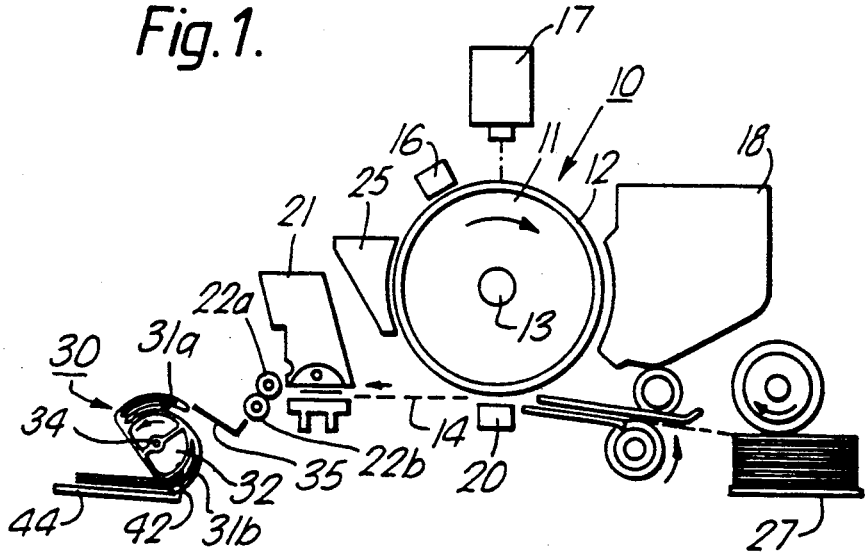
FIG. 1 is a schematic cross sectional representation of a xerographic copier incorporating the sheet inverter and stacker of the present invention.

Referring to FIG. 1, there is shown an automatic xerographic copier 10 which incorporates the sheet inverter and stacker 30 of the present invention. The copier 10 shown in FIG. 1 illustrates the various components utilized therein for producing copies from an original document. Although the sheet inverter and stacker of the present invention is particularly well adapted for use in an automatic copier, it will be evident from the following description that it is equally well suited for use in a way variety of other machines where it is desired to invert and stack processed sheets. It is not limited in its application to the embodiment shown herein.

The copier 10 employs an image recording drum-like member 11, the outer periphery of which is coated with a suitable photoconductive material. The drum 11 is suitably journaled for rotation within a machine frame (not shown) by means of a shaft 13 and rotates in the direction indicated by the arrow to bring the image retaining surface thereon past a plurality of xerographic processing stations. Suitable drive means (not shown) are provided to power and coordinate the motion of the various cooperating machine components whereby a faithful reproduction of the original input document is recorded upon a copy sheet 14. Initially, the drum 11 moves photoconductive surface 12 through charging station 16 where an electrostatic charge is placed uniformly over the surface 12 of the drum 11 preparatory to imaging. The charging may be provided by a corona generating device.

Thereafter, the drum 11 is rotated to exposure station 17 where the charged photoconductive surface 12 is exposed to a light image of the original document, whereby the charge is selectively dissipated in the light exposed regions to record the original document in the form of a latent electrostatic image.

The optical system may be a conventional scanning or stationary optics or may be an electronically controlled and actuated laser source which successively strikes the photoconductive surface as a raster scan.

After exposure, drum 11 rotates the electrostatic latent image recorded on the photoconductive surface 12 to development station 18 where a conventional developer mix is applied to the photoconductive surface 12 rendering the latent image visible. Typically, a magnetic brush development system utilizing a magnetizable developer mix having carrier granules and a toner colorant is used. The developer mix is continuously brought through a directional flux field to form a brush thereof. The electrostatic latent image recorded on photoconductive surface 12 is developed by bringing the brush of developer mix into contact therewith.

The developed image on the photoconductive surface 12 is then brought into contact with a copy sheet 14 within a transfer station 20 and the toner image is transferred from the photoconductive surface 12 to the contacting side of the copy sheet 14. The copy sheet may be paper, plastic, etc. as desired. After the toner image has been transferred to the copy sheet 14, the sheet with the image thereon is advanced to a suitable radiant fuser 21, which coalesces the transferred powder image thereto. After the fusing process, the sheet 14 is advanced by output rolls 22*a*, 22*b* to an inverter and stacker 13 in accordance with the invention and described in detail below.

Although a proponderance of toner powder is transfer to the copy sheet 14, invariably some residual toner remains on the photoconductive surface 12 after the transfer of the toner powder image to the copy sheet 14. The residual toner particles remaining on the photoconductive surface 12 after the transfer operation are removed therefrom as it moves through cleaning station 25. Here the residual toner particles are first brought under the influence of a cleaning corona generating device (not shown) adapter to neutralize the electrostatic charge remaining on the particles. The neutralized toner particle are then mechanically cleaned from the photoconductive surface 12 by conventional means such as, for example, the use of resiliently biased knife blade.

If desired a supply of copy sheets 14 to be processed in the copier may be stored within a removable paper cassette 27.

It is believed that the foregoing description is sufficient for purposes of the present application to illustrate the general operation of the automatic xerographic copying machine 10 which can embody the present invention.

Figure 2:
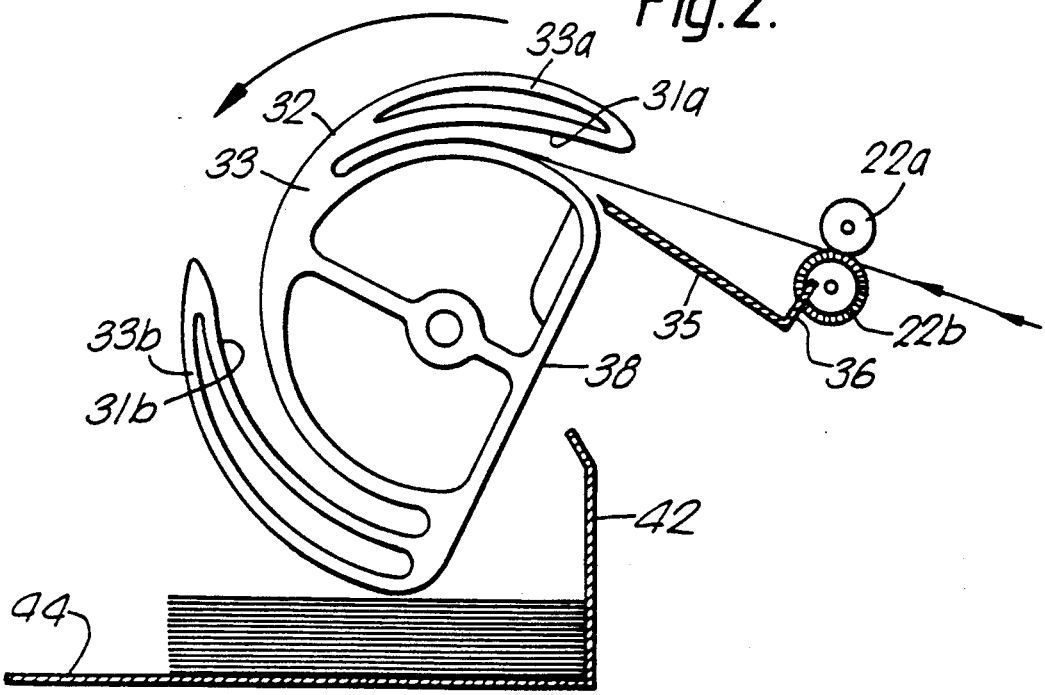
FIG. 2 is a cross section of the inverter and stacker in one sheet loading position.

Referring now also to FIG. 2, the inverter stacker 30 comprises a sheet inverter wheel 32 having two identical disc-like members 33 which are spaced apart axially and are mounted on the same drive shaft 34 which is driven, for example, via a wrap spring clutch or other indexing mechanism. The direction of rotation of the inverter wheel is indicated by the arcuate arrow in the Figures. The inverter wheel 32 may also comprise an interior stationary drum which is generally cylindrical to support sheets held in the inverter as disclosed in detail in the aforementioned U.S. Pat. No. 4,385,756, but not shown here. Also, it is noted that the inverter wheel 32 may comprise more than two disc-like members 33.

Each disc-like member 33 comprises two slots 31*a*, 31*b* of differing widths. The slots 31*a*, which are formed by arcuate arms 33*a*, are capable of accommodating single sheets and small sets of up to a maximum of, say, 10 sheets; whereas the larger slots 31*b*, which are formed by arcuate arms 33*b*, can accommodate much larger sets of up to, say, 100 sheets. The disc-like members 33 are mounted on drive shaft 34 such that their respective slots are mutually aligned.

The inverter stacker 30 is disposed at the output station of the fuser 21, as shown in FIG. 1. Copy sheets issuing from the fuser are transported to the inverter stacker 30 by a pair of coating feed rolls 22*a*, 22*b*. A compiler tray 35 (whose function is discussed in more detail below) is disposed on the exit side of the feed roll pair 22*a*, 22*b* immediately before the inverter wheel 32. The compiler tray 35 is upwardly inclined in the direction of sheet feed and has a rear registration stop 36 at its lowermost edge.

The operation of the inverter stacker 30 will now be described for inverting single sheets, that is to say for N−1 copying with face up copies or 1−N copying with face down copies.

The inverter wheel 32 is indexed to the single sheet loading position shown in FIG. 2 with the narrower slots 31*a* ready to accept sheets exiting the copier. The rolls 22*a*, 22*b* feed a copy sheet into the throat of the slots 31*a* and continue to feed the sheet until its trail edge leaves the rolls 22*a*, 22*b* completely at which stage the leading edge of the sheet approaches the ends of the slots 31*a*. The inverter wheel 32 is then rotated counterclockwise through about 180° C. and carries with it the sheet to be inverted. At the loading position the leading edge of the sheets in the slots 31*a* abuts upstanding stripping registration member 42 which inhibits further travel of the sheet. The inverter wheel 32 continues to rotate until the arms 33*a* have cleared the sheet stripping zone and thus the sheet is stripped from the slots 31*a* and falls gently under gravity into catch tray 44 with its lead edge registered against the stripping registration member 42. Suitably the stripping registration member 42, which is disposed between the two discs 33, is formed integrally with the catch tray 44.

The inverter wheel 32 continues its rotation until it resumes its initial sheet loading position (shown in FIG.2) to accept the next sheet to be inverted and this cycle continues until all the copy sheets issuing from the copier have been inverted.

The operation of the inverter stacker 30 will now be described for inverting sets of sheets, that is to say for 1−N copying with face up copies or N−1 copying with face down copies.

Figure 3:
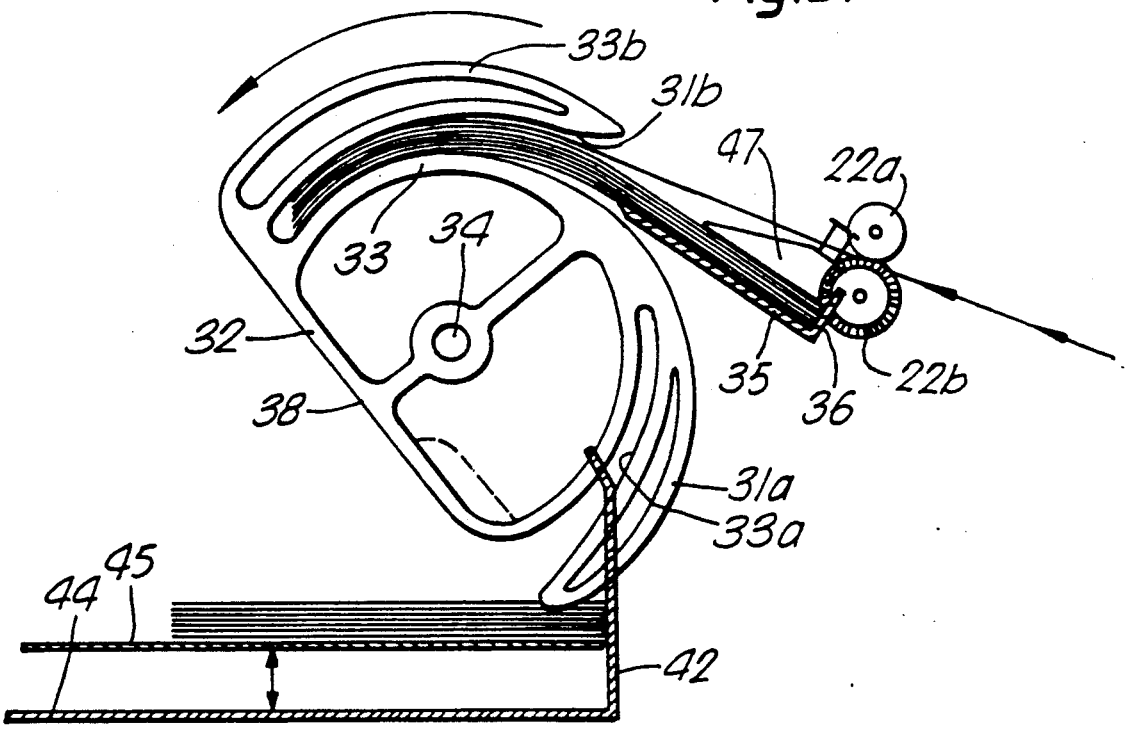
FIG. 3 is a cross section of the inverter and stacker in a second sheet loading position.

For stacking sets of up to typically about 100 sheets, the inverter wheel 32 is indexed to the set loading position shown in FIG. 3 with the wider slots 31*b* ready to accept copy sheets exiting the copier. The rolls 22*a*, 22*b* introduce a first copy sheet into the throat of the slots 31*b* and continue to feed the sheet until the trail edge completely leaves the rolls 22*a*, 22*b* at which stage the leading edge of the sheet approaches the ends of the slots 31*b*. The lower roll 22*b*, which is preferably made of a compliant, spongy material such as plastics foam acts to urge the trail edge of the copy sheet down into the compiler tray and into positive engagement with the rear registration stop 36. The inverter wheel remains stationary while second and subsequent sheets are fed into the slots 31*b* and are collated on top of the previously stacked sheets held in the slots 31*b* and supported by compiler tray 35. Sheet feeding continues until all the sheets of a set have been fed and are held in the inverter stacker 30. The set of sheets have their rear edges registered against the registration stop 36 aided by the action of foam roll 22*b* and the downward tilt of compiler tray 36. At this point, the set of sheets may be stitched or stapled, if desired, for example by means of a stapler indicated at 47.

The inverter wheel 32 is then rotated through about 180° and carries with it the set of sheets to be inverted. At the unloading position the leading edges of the set of sheets in the slots 31*b* simultaneously about the stripping registration member 42 on catch tray 44. As the inverter wheel 32 continues to rotate the arms 33*b* clear the stripping zone and the set of sheets is deposited into the catch tray 44. The catch tray 44 may comprise an elevating platform 45 which may be lowered each time a new set is deposited in the tray 44 to ensure that the set of sheet remain accurately registered. Also, the platform 45 may be movable laterally with respect to the inverter wheel 32 in order to offset successive sets of sheets. Of course the inverter wheel itself may be shifted laterally relative to the platform 45 or alternatively the set of sheets may be laterally displaced in the inverter wheel 32 before inversion in order to offset the sets stacked in the catch tray 44.

It has to be noted here that the narrower slots 31*a* in disc-like members 33 may similarly be used for collating sets comprising a small number of up to typically about 10 sheets before inversion. In this case the foam roll 22*b* similarly acts to urge the trail edge of the copy sheets into the compiler tray 35 and into positive engagement with registration stop 36; and the inverter wheel 32 waits to be rotated until all the sheets of a particular set have been received.

Figure 4:
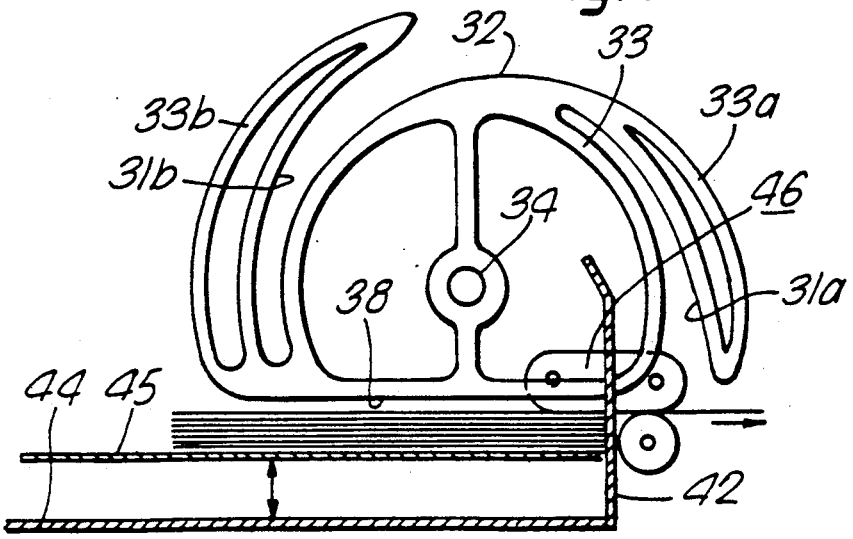
FIG. 4 is a cross section of the inverter and stacker in a sheet feeding position.

The sheet inverter 30 of the present invention may also be used in a re-feed mode, shown in FIG. 4, if it is desired to feed copy sheets out of the catch tray, for example, back into the xerographic copier for a second copy pass on the same side, e.g. for color copying, or for copying on the reverse side.

To this end the disc-like members 33 are provided with a flat portion 38 between the slots 31*a* and 31*b*. In this mode, the inverter wheel 32 is rotated until the flat portion 38 lies parallel to the stack of sheets in the catch tray 44. The stack is then raised on an elevating platform 45 to bring the top sheet into feeding engagement with a feed head 46 disposed between the two disc-like members 33. The feed head 46 operates in conventional manner to feed the copy sheets from the stacking tray 44 back to the copier for further processing.

The patent referred to herein is hereby specifically and totally incorporated herein by reference.

In view of the foregoing description, it will be evident to a person skilled in the art that various modifications may be made within the scope of the present invention. For example, while the present invention has been illustrated with reference to a copier it has equal application to a printer apparatus wherein a beam of light such as a laser beam may be used to selectively discharge the photoconductor. It is intended to embrace all such modifications and embodiments as may fall within the spirit and scope of the appended claims.

What is claimed is:

1. A sheet inverting and stacking apparatus comprising a sheet inverter wheel having at least one arcuate slot into which a sheet to be inverted may be inserted, means to rotate the inverter wheel from a sheet loading position to a sheet unloading position, means for feeding sheets one at a time into the arcuate slots when the inverter wheel is in the loading position, a sheet stripper at the unloading position for stripping a sheet from within the slot, and a catch tray adjacent the unloading position for holding inverter sheet(s) stripped from the slot in the inverter wheel said slot being adapted to accommodate a plurality of sheets, and a compiler tray adjacent the loading position for supporting the trailing portions of the sheets fed into the slot by the sheet feeding means, said compiler tray having a registration edge against which the trail edges of the sheets abut when they have been fed into the slot by the sheet feeding means.

2. A sheet inverting and stacking apparatus as claimed in claim 1, wherein the compiler tray is upwardly inclined in the direction of sheet feed and the registration edge is provided at the lowermost edge of the compiler tray.

3. A sheet inverting and stacking apparatus as claimed in claim 1, wherein the sheet feeding means comprises a coating pair of driven rollers adjacent the upstream end of the compiler tray.

4. A sheet inverting and stacking apparatus as claimed in claim 3, wherein one of the rollers is adapted to urge the sheet being fed positively into the compiler tray.

5. A sheet inverting and stacking apparatus as claimed in claim 1, wherein the sheet inverting wheel comprises at least two substantially identical, axially spaced-apart disc-like members having their respective slots mutually aligned.

6. A sheet inverting and stacking apparatus as claimed in claim 1, wherein means are disposed adjacent the compiler tray for stapling or stitching a set of sheets supported in the compiler tray while the inverter wheel is in the loading position.

7. A sheet inverting and stacking apparatus as claimed in claim 1, wherein the inverter wheel comprises two arcuate slots into which sheets may be inserted, the first slot being adapted to accommodate a number of sheets up to a first maximum, and the second slot being adapted to accommodate a greater number of sheets up to a greater second maximum.

8. A sheet inverting and stacking apparatus as claimed in claim 7, wherein the inverter wheel has a flattened portion between the slots and the rotation means is adapted to rotate the wheel to a sheet feeding position at which the flattened portio of the wheel lies substantially parallel to the catch tray and the catch tray comprises an elevating platform to bring the stack of sheets held therein into engagement with means for feeding sheets out from the catch tray.

* * * * *